US005330278A

United States Patent [19]

Raswant

[11] Patent Number: 5,330,278

[45] Date of Patent: Jul. 19, 1994

[54] COORDINATED TRAFFIC SIGNAL SYSTEM FOR ROADS

[76] Inventor: Subhash Raswant, 84-49 168th St., Jamaica, N.Y. 11432

[21] Appl. No.: 932,350

[22] Filed: Aug. 19, 1992

[51] Int. Cl.[5] ..... E01C 1/00

[52] U.S. Cl. ..... 404/1

[58] Field of Search ..... 404/1

[56] References Cited

U.S. PATENT DOCUMENTS 3,945,745 3/1976 Chang ..... 404/1

*Primary Examiner*—Mark Rosenbaum
*Assistant Examiner*—Kenneth S. Hansen
*Attorney, Agent, or Firm*—Henry R. Lerner; Andrew S. Langsam

[57] ABSTRACT

A method for coordinating traffic signals on a roadway network, preferably of the Multiple Loop System type. The method is also suitable for superimposing on existing grid-like systems of avenues and crossing streets. Two phase traffic-signals, red and green, of equal duration are employed at the roadway intersections. The duration of each phase of the signal cycle is determined as the estimated time for a vehicle to travel from one crossing avenue to the next adjacent crossing avenue. Where the method of signalization is employed on an MLS system, the phase duration is the "estimated time" of a vehicle to travel, first along an endless loop segment, starting at a first intersecting roadway so as to cross the next interconnecting roadways, (ta) times two, and, then, along an interconnecting roadway, from a first endless loop segment to the adjacent endless loop segment (tb). A band width is determinable from the calculation of the duration of the phases and corresponds to the integral number of roadway intersections crossed by a vehicle, travelling only on an endless loop segment, for the duration of a single phase of the two phase signal cycle. Adjacent band widths of a single endless loop segment are in the reciprocal phase from one another. Parallel band widths, on adjacent endless loop segments, are also in the reciprocal phases from one another and, interfacing band ends are also in a reciprocal phasing sequence relation to one another, so as to produce a checkerboard pattern of alternating red and green phases of the traffic signals.

27 Claims, 8 Drawing Sheets

MLS SIGNALIZATION AVE'S. A1, A3, & A5 in green.

MLS SIGNALIZATION AVE'S. A1, A3, & A5 in green.

MLS SIGNALIZATION AV'S. A1, A3, & A5 in red.

MLS SIGNALIZATION ON MULTIPLE BANDS AVE' S. A1, A3, & A5 IN GREEN ON BAND B2.

RECIPROCAL PROGRESION BETWEEN ADJACENT AVE'S.

COORDINATED TRAFFIC SIGNAL SYSTEM FOR ROADS

BACKGROUND OF THE INVENTION

This invention relates to vehicular and pedestrian traffic flow and traffic light controls. In particular, the present invention relates to a method and system for increasing the flow of vehicular traffic on city streets and avenues while minimizing idling time and intermodal conflicts. Intermodal conflicts, as used herein, refers to slowing of vehicle traffic flow due to the potential for an accident or injury, involving either two or more vehicular streams of traffic, or, a vehicle and a pedestrian stream of traffic at street intersections. Intermodal conflicts are, of course, life threatening and in addition, they increase travel time while disrupting smooth traffic flow. The present invention is particularly suitable for being superimposed on existing grid-like systems of crossing roads or streets and avenues, as, for example, those that currently exist on the island of Manhattan, within New York City. A grid-like system as used herein, refers to a road network having primarily parallel roads (preferably with wide pavement, like avenues) with intersecting cross streets or roads, as in the case of Manhattan, cross-streets (less wide pavement) at right angles to the avenues.

The present invention relates to a method and system for controlling the traffic signals (red and green lights) on the avenues and streets in such a manner that idling time is minimized while vehicular traffic flow is maximized, all with reduced intermodal conflicts. The present invention is intended for and preferably used along with my Road Traffic Network, referred to herein as the Multiple Loop System, described in and illustrated by my already issued U.S. Pat. No. 4,927,288 issued May. 22, 1990. The teachings of my Road Traffic Network or Multiple Loop System (hereinafter the "MLS") are incorporated herein by reference. In addition, my other already issued patent, U.S. Pat. No. 5,092,705 issued Mar. 3, 1992, relating to a method and system for controlling vehicular and pedestrian traffic at intersections of the MLS is also incorporated herein by reference. U.S. Pat. No. 5,092,705 describes a vehicular and pedestrian traffic pattern flow system. In brief summary, that patent relates to a method for controlling the vehicular traffic light signals at intersections of avenues and cross streets, along with "Walk No Walk" traffic signals for pedestrians at the cross walks, so that the MLS system operates to its maximum efficiency, all while preserving safety and reducing intermodal conflicts.

The present invention relates to a method and system for simultaneously controlling traffic signals at a plurality of intersections on a grid network. The duration of the timed phases of the vehicular traffic light signals is set according to a formula based on safe yet anticipated travel speeds. The invention also relates to a system for coordinating the traffic signals for adjacent avenues and intersecting cross streets of the MLS system. Preferably, the present invention is coordinated with both the MLS System and the method of controlling vehicles and pedestrians (the '705 patent) so that travel and idling time for vehicles is minimized while maximizing traffic flow. This is of course environmentally desirable and, in addition, will reduce vehicle operators' frustration as a consequence of traffic congestion and allow more vehicles to travel on the same road network in less time, without gridlock. It should reduce traffic problems and the attendant negatives associated therewith. The present invention accomplishes these goals while preserving safety and reducing intermodal conflict.

DESCRIPTION OF THE PRIOR ART

As previously mentioned, this invention preferably relates to my MLS system of traffic flow and, in addition, to my method and system for controlling vehicular and pedestrian traffic flow on the MLS. The invention also relates to grid-like traffic system, not necessarily operating according to the MLS principles. The known prior art includes the publication "Walk Signals For Pedestrians", published in the American City Magazine, Traffic Control and Facilitation, by W. A. Duzer at page 105, May, 1937. That seems to be the first suggestion of providing "Walk/Don't Walk" signals for pedestrians at crosswalks for facilitating the safe movement of pedestrians across streets and avenues while vehicular traffic is allowed to continue, also, on the same streets and avenues. It is an early suggestion of minimizing intermodal conflict.

Many congested cities have made at least some effort at spreading traffic flow by coordinating, progressing, and phasing traffic signals both for the vehicular traffic and pedestrians. In so doing, it is desired to minimize idling time for the vehicles. In this connection, in New York City, the main one-way northerly and southerly running avenues are generally provided with "go" or green lights for automobiles and trucks of about 60 seconds duration, while the perpendicular cross streets are provided with "go" or green lights for vehicular traffic of only about thirty seconds duration. That signalization method is intended to maximize traffic and pedestrian flow on the avenues which are capable, because of their pavement width, to carry more vehicular traffic than the cross streets and yet, intermodal conflict is reduced (by use of "Walk/Don't Walk" signals), as is idling time and overall travel times.

In addition, along the avenues, at least, some efforts at light progression has been adopted so that lights are progressively turning green, allowing vehicles to flow, as the vehicles travel towards the upcoming intersections.

The present invention, when used in connection with the MLS and the method and system for facilitating pedestrians and vehicular traffic to flow on an MLS, will further help minimize potential accidents between vehicles and between vehicles and pedestrians. The present invention is a significant advance over the prior art and facilitates and allows the MLS system to be utilized to its maximum efficiency, especially on a grid plan-like system (including concentric plan types) of existing or to-be-built roads, in an urban environment.

SUMMARY OF THE INVENTION

Three factors are generally considered as critical to the movement of people on urban streets, namely, safety, capacity for vehicles and pedestrians, and travel time. The underlying rationale for transportation planners is the desired goal of safely moving the greatest amount of traffic in the shortest possible time, with minimal intermodal conflicts, i.e., possible or actual accidents.

In reality, however, under current practice, the state of the art of transportation and traffic flow within an urban environment leaves much to be desired in that the movement of traffic and pedestrians on current city streets and avenues is neither as safe as it should be, efficient or uncongested. Road accidents between vehicles and between vehicles and pedestrians, idling time delays and gridlock are, unfortunately, every day city occurrences and qualitative "statements" associated with the condition of traffic on large metropolitan roadways. All three factors, safety, capacity and time, are effected by the manner in which traffic (vehicle and pedestrian) flow is currently "controlled" on roadways and/or street intersections. While the roadway intersections are individually controlled and even, on occasion some adjacent intersections, have signal cycle progression, there has not been any gross or system wide coordination of traffic signalization.

More specifically, in the present systems street intersections are signalized, i.e., vehicles and pedestrians are controlled by traffic signals showing red or green lights (corresponding to "Stop" or "Go" and "Walk/Don't Walk" signs, respectively, to allow traffic and pedestrians to flow to desired parts of the city, to improve intermodal safety. Pedestrian crosswalk waiting time, fuel consumption and air pollution and vehicle idling time at intersections is the tradeoff for intervehicular and pedestrian safety at intersections, i.e. conflict is desirably reduced but comes at the expense of travel time and idling time in the existing condition.

Recently, deterioration in traffic flow, increase in travel time and overall transportation congestion has prompted some urban planning professionals to express a need for a radical redesign of the street system and/or a reexamination of the manner in which traffic and pedestrian flow is made to move on urban systems.

The innovative traffic system envisioned by the MLS (basically, the total avoidance of vehicle cross-overs), the method of separating vehicular and pedestrian traffic, at grade, on an MLS having grid intersections (the '705 patent), and the development of a method for signalization of vehicles on an MLS (the present invention) results in a unique pattern of urban traffic circulation and control that is both safer and more efficient than existing traffic flow. Improved travel times, lower fuel consumption levels, reduced frustration, reduced idling, and improvement in air quality levels in cities would result from implementation of the MLS system and the present invention.

As will be more fully described, the present invention relates to coordination of traffic signals on a grid system of intersecting roadways and, preferably on a MLS road to maximize traffic flow and minimize idling time. The present invention is preferably superimposed on the MLS system (described in my first issued U.S. Pat. No. 4,927,288) and, further, is intended to also be utilized with the method of coordinating and controlling pedestrian and vehicular traffic flow (described in my second U.S. Pat. No. 5,092,705). However, the present invention need not necessarily be utilized with either of those two inventions but, rather, can exist merely by being superimposed on existing roads in the typical grid format as, for example, those that currently exist in New York City (comprised of avenues and cross-streets intersecting, for the most part, at right angles to one another).

Briefly stated, the present invention contemplates using two phase cycles of traffic signals at intersections, both cycles being of substantially equal time duration. These traffic signals would be located at all roadway intersections. All signals, along a given avenue, for example, within a stated band width, i.e., for a limited number of streets, 5, for example, would be in the same phase for the signal cycle while adjacent band widths on the same avenue, would be in the reciprocal signal phase. So, for example, 5 adjacent traffic signals at intersections on an avenue would all turn green, while the immediately adjacent 5 traffic signals at intersections, on the same avenue, both uptown and downtown of the green signals, would all turn red.

For parallel band widths, on adjacent avenues the traffic signal cycles originally would also be in the reciprocal phase. So, when the 5 signals turn red on a first avenue, the 5 signals on adjacent avenues, west and east, turn green. The duration of a single phase of the two phase signal cycle, "P", is determined and calculated and must be greater than the time for pedestrians to stroll across a street or avenue. In the MLS, "P" is set at about the amount of "time" for a vehicle to safely travel, starting on an avenue at a cross street intersection, to the next street intersection, times two, and then travel on a cross street, from one avenue intersection to the adjacent avenue intersection. From that determination of "P", the length of the red and green phases of the two phased signal cycle, the band width is also determined. The band width "n" (an integer) is equal to the number of intersections that a vehicle is likely to pass, travelling on a given avenue, for the duration of phase P of the two-phase signal cycle. Immediately adjacent band widths on the same avenue are opposite in phase to each other; while parallel band widths on immediately adjacent avenues are also opposite in phase relative to one another.

In the case of the MLS, then P equals $2ta+tb$ when "ta" is the travel time between adjacent streets, travelling along an avenue and "tb" is the travel time between adjacent avenues travelling on a crossing street. In a simple grid system, where the requirements of the MLS are not followed, P equals tb, because "ta" equals 0 (zero).

These, and other objects of the present invention, are accomplished and will be more easily understood with reference to the accompanying set of drawings, which are described herein.

BRIEF DESCRIPTION OF THE DRAWINGS

FIG. 4 is a schematic showing the traffic pattern of a single vehicle travelling in a manner consistent with MLS and showing the manner of calculating "P" for the MLS. P is the phase duration of each signal of the two phase signal cycle.

DETAILED DESCRIPTION OF THE DRAWINGS AND THE PREFERRED EMBODIMENT

Figure 1:
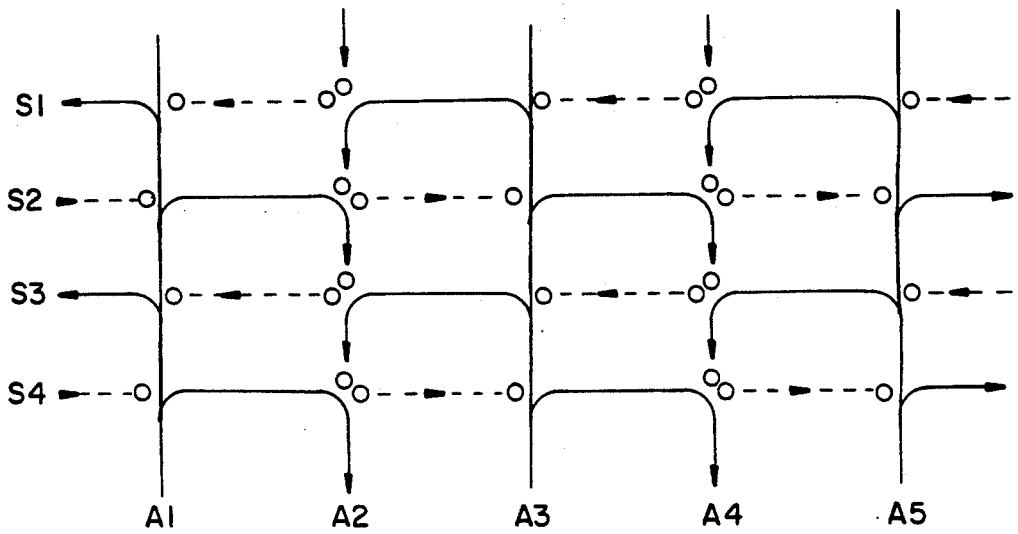
FIG. 1 is a schematic of the present invention showing signalization on parallel one way, relatively high traffic bearing avenues (A1 through A5) running North and South, with adjacent avenues in opposite directions to one another. Avenues A1, A3 and A5, show for phase P, green or go lights and providing for traffic flow in the northerly direction, while avenues A2 and A4, transporting traffic in a southerly direction, are initially provided with red or stop lights for time duration P. S1–S4 are the intersecting cross streets.
Figure 2:
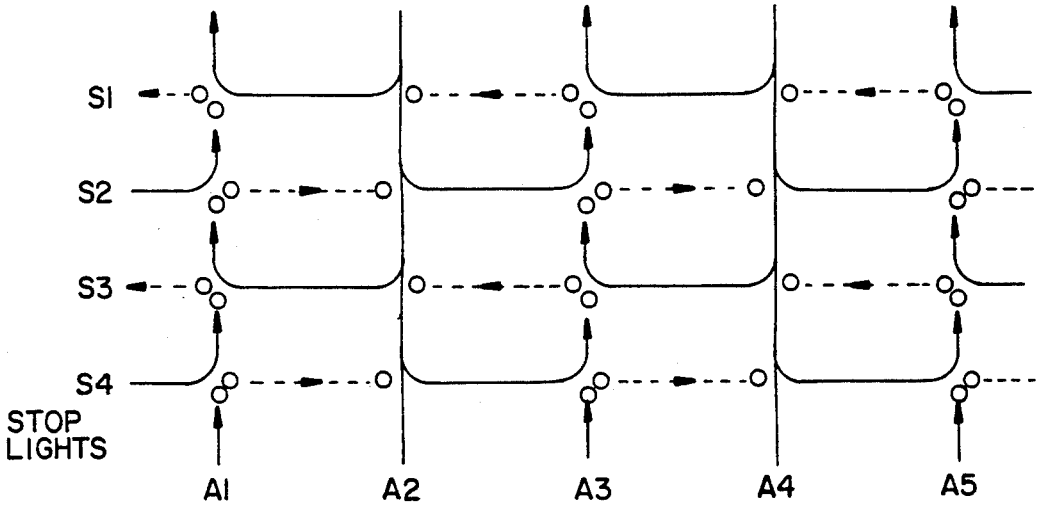
FIG. 2 is a schematic view of the same set of avenues (A1–A5) and cross streets (S1–S4) yet time sequenced one signal phase, P, from the phase shown in FIG. 1 such that avenues A1, A3 and A5 are now provided with red or stop lights for traffic flow (still northerly) while avenues A2 and A4, providing for vehicular traffic flow in a southerly direction are now provided with the green or go lights. The small circles on FIGS. 1 and 2 schematically represent the red phase of the traffic signals at the intersections.

As can be seen from FIGS. 1 and 2, it is desired in the MLS system and, according to the present invention, that immediately adjacent avenues (called loop segments in my '288 patent) provide for traffic flow in opposite directions to one another and, further, consistent with the present invention of traffic signalization, when traffic is allowed to flow along one loop segment of the MLS system, by being presented with a green or go traffic signal, (with respect to New York City, a segment of a loop is an avenue) traffic flow on an adjacent avenue, for the same band width (i.e., the same number and parallel location of crossing streets) is stopped by a red traffic signal.

FIGS. 1 and 2 illustrate time and motion changes for vehicular traffic in both phases of the two phase traffic signal cycle. As mentioned, for the example shown, north/south avenues are designated A1 through A5 with A1, A3 and !5 providing for traffic flow only in the northerly direction, while avenues A2 and A4 provide for traffic flow only in the southerly direction. All avenue intersections have traffic signals which direct vehicles to either go or to stop, green light or red light, respectively.

All minor east to west and west to east crossing streets, for the purposes of illustrating the invention, are designated S-1 through S-4 with odd numbered streets S-1 and S-3 providing for one-way traffic flow westerly, with the even numbered cross streets, S-2 and S-4 providing for one-way traffic flow easterly. The direction of permitted vehicular movement, consistent with MLS, is shown in FIGS. 1 and 2 by the arrows.

While existing traffic lights in urban areas provide two or more signal phases as, for example, a green light, a left turn signal, and a red light ( three representative phases ) the signalization system contemplated by the present invention for the MLS system is a simple two-phase cycle, namely, a green phase followed by a red phase. Of course, the yellow or cautionary light can also be utilized to indicate the oncoming red phase, without departing from the present invention. According to the present invention, however, again, in contrast to the current existing varied signals and differing duration of phases in the multi-signal cycle within urban areas, the two phases of the present invention are basically equal to one another so that, according to the present invention, the length of duration of a green light along an avenue is substantially equal to the length of duration of a red light on the same avenue. Correspondingly, a green light for traffic on a street going across an avenue (while the avenue traffic has, of course, a red light) will be substantially equal to the red light duration for the same cross street. Obviously, therefore, the green light for traffic on the avenues is of substantial equal duration to the green light duration for the traffic on the cross streets and the duration of the red lights for traffic on the avenues is substantially equal to the red light duration for traffic on the crossing streets. This is in contrast to the present system of signalization of grid-like streets which generally provides for longer green light time for avenue traffic than green light time for crossing streets.

According to the present invention, a band width is defined as the maximum distance that a vehicle platoon or stack of cars is likely to move in a given direction along the axis of a portion of a major loop, in the case of Manhattan, along a north/south avenue, for a single phase (the green light phase) of a signal cycle. Band widths are expressed in whole numbers, "n", which is equal to the number of traffic lights at intersecting streets that are likely to be cleared by the car of a platoon length or stack of cars travelling straight on an avenue during the single green light phase of the signal cycle. According to the present invention, an entire band width is simultaneously in the same signal phase while immediately adjacent band widths, on the same avenue, are in the opposite or reciprocal signal phase. Band widths on immediate! v adjacent avenues also display the reciprocal or opposite phase of the signal cycle displayed on the first avenue. Thus, a checkerboard pattern is displayed on a grid roadway system.

For example, with respect to Manhattan, when traffic on Second Avenue (a segment of a continuous loop of the MLS) provides vehicular traffic flow only in the southerly direction. Then, consistent with MLS, the adjacent avenues, First and Third Avenues, will provide for vehicular traffic flow in the northerly direction. A band width, calculated as five traffic lights (the calculation follows herein) could have one end or band interface at, for example, 34th Street. That 5-street band width then will thus extend to 39th Street. Thus, 34th to 39th Street, along the avenues, are band width, B2. Consistent with the present invention, when the green phase of the traffic signal, at the intersection of 39th Street and Second Avenue commences, all other traffic signals in the same band width, i.e., between 34th Street and 39th Street are also in the green phase. On the adjacent avenues, 1st and 3rd, the traffic signals for traffic thereon, extending in the same band width B2, i.e., between 34th Street and 39th Street are in the opposite or red phase. When the entire bandwidth, again, for this example, 34th Street through 39th Street on Second Avenue turns to red, after the green phase completes its duration (preferably about 46 seconds) all traffic signals within the bandwidth will turn red and, at the same time, the band widths B2 on adjacent avenues, First and Third, extending between 34th Street and 39th Street will simultaneously turn to green.

Adjacent band widths along the same avenues are also in opposite phase relative to one another. For example, a second band width, B3, extending from 40th Street to 45th Street and another, B1, from 28th through 33rd Street will be in the reciprocal signal (phases) of the traffic signal on the first band width B2 on the same avenue. Thus, when the first band width on Second Avenue, B2, (34th to 39th Street) is in its green phase, the adjacent band widths, 28th-33rd, B1 and 40th-45th, B3 are in the red phase. B1 and B3, on First and Third avenues are, of course, in opposite phase to that on B1 and B3 for Second Avenue.

Figure 3:
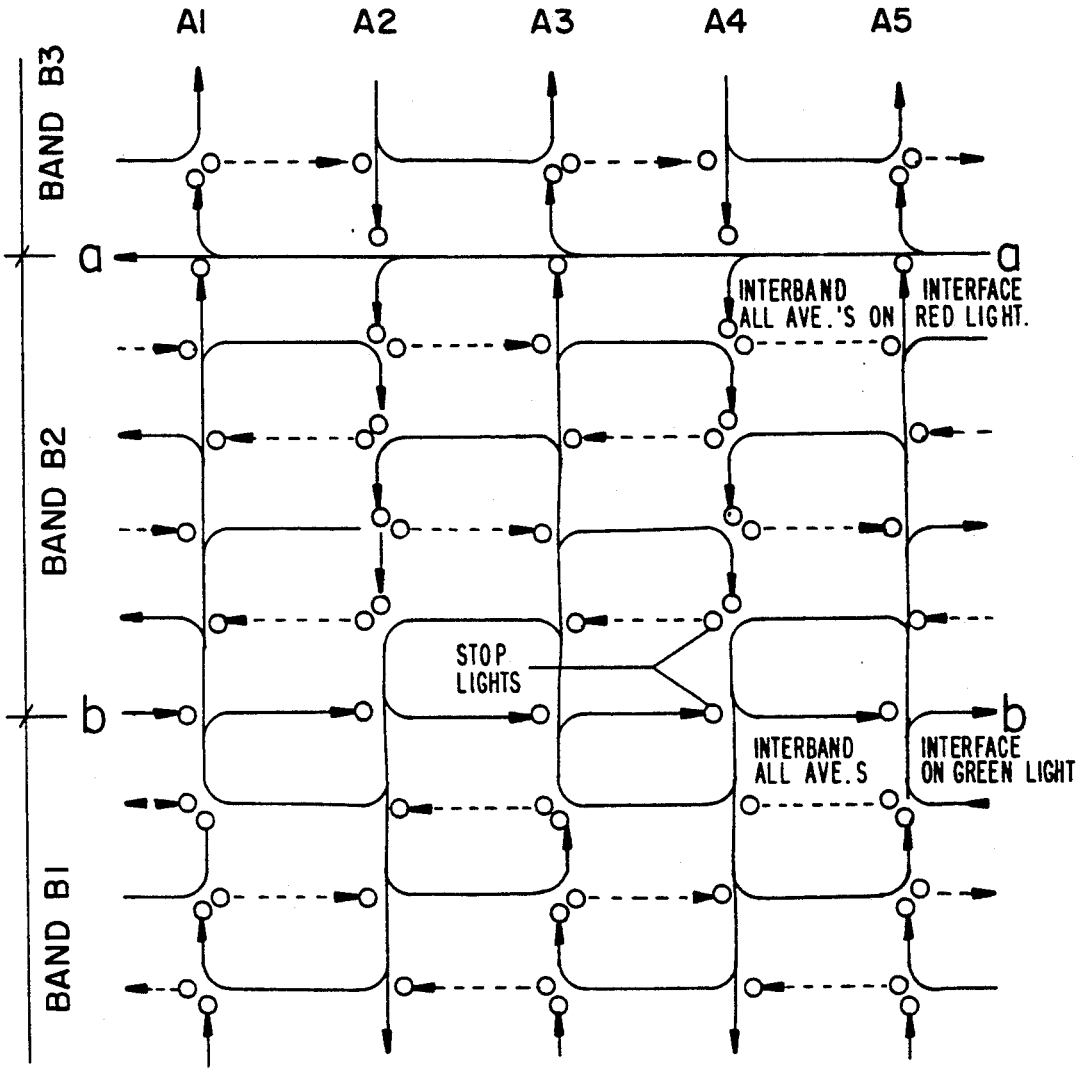

The requirement in the present invention, that the same or parallel bandwidths on adjacent avenues and adjacent bandwidths on the same avenue, be in the reciprocal or opposite phase of the traffic signal on a first bandwidth on a first avenue, produces a checkerboard-like traffic signal plan. This is shown in FIG. 3. It illustrates the pattern of permitted vehicular movement (solid lines and arrows) and the distribution of red lights (circles) for one full (B2) and two partial (B1 and B3) bandwidths along five adjacent avenues (A1-A5). As can be seen, when one band width, B2, on Second Avenue (A2) is in its red phase, the same or parallel band width, B2, on the adjacent avenues, First and Third Avenues, A1 and A3, are in their reciprocal or green phase. When B2 is in its green phase, for avenue A1, then A3 and A5 are also in their green phase, again, for bandwidth B2. When bandwidth B2 on Avenues A1, A3 and A5 are green, adjacent bandwidths B1 and B3, on the same avenues (A1, A3 and A5) are red, i.e., in the reciprocal or opposite phase of the two phase signal cycle. As previously discussed, according to the present invention, the phases, i.e., red and green, of the two phase traffic signal cycle, according to the present invention, are of substantially equal time duration.

As shown in FIG. 3, band interfaces (a—a and b—b) crossing major avenues A1-A5 are defined as the overlapping of terminals or ends of the band widths B2-B3 and B2-B1. The signal cycle at a first band interface, a—a, a crossing street, according to the present invention, is in reciprocal phase to the traffic signal-phase of the adjacent band interface, b—b. Thus, as seen in FIG. 3, when band interface a—a is in its green phase of the traffic signal cycle, band interface b—b is in its red phase of the traffic signal cycle.

A modification to the otherwise strict requirement of the MLS system that no traffic "cross over" other traffic provides, as illustrated by a—a of FIG. 3, that, at major cross streets (those with wider pavement than minor cross streets, as, in the Manhattan example, 34th Street and 42nd Street) traffic can flow directly from east to west and west to east in a straight path, without the necessity for weaving.

Figure 4:
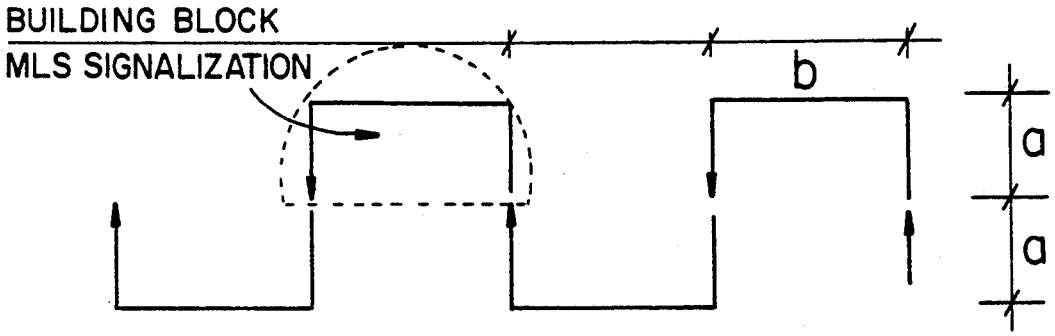
FIG. 4 is a schematic bird's eye view of a larger portion of the grid-plan roadway network of avenues and streets, with arrows indicating direction of traffic flow and small circles again indicating the red phase of traffic signals, i.e., providing for the stoppage of traffic. This figure shows one full band width (B2) and two partial band widths (B1 and B3) for a first avenue and adjacent avenues, too.

The mathematical determination of the duration of the single red or green phase of the two-phase traffic signal cycle is defined by the time that it would take a vehicle to travel from one avenue to an adjacent avenue, and able to continue in the same direction. In the MLS, this requires a U-shaped traffic pattern. More specifically, the duration of a single phase is the amount of time that it would take a vehicle to travel from a traffic light at a first avenue and street intersection, travelling first along the avenue, to the next avenue and street intersection, times two, and then, making a turn onto the cross street, traveling on the cross street to the adjacent avenue. This U-shaped "trip" determines the duration of a phase, P, in seconds, and is illustrated in FIG. 4. In mathematical terms, therefore, the duration of the red phase (equal to the green) P, is equal to twice the-travel time for a vehicle to travel the distance "a" plus "b" where "a" is the center line distance between adjacent streets and "b" is the center line distance between adjacent avenues. Where traffic is not directed in accordance with MLS, "a" equals 0 (zero) and thus P equals "b". In professional jargon "P" is also equal to the off-set interval for the progression of vehicular flow throughout the street network. "P" may be changed for different traffic conditions during different traffic conditions in the course of a typical day.

A bandwidth is the travel time that a vehicle will take to move from one portion of an avenue to another, in time interval P. For example, if a vehicle is starting at a red light which is the second such light in a series of five traffic lights which change phase simultaneously, then the time for the vehicle to travel to the second traffic signal of the next adjacent band width, traveling straight along an avenue, A2, for example, is the same time that it would take a vehicle to travel "2a38 , twice the center line distance between adjacent streets, plus "b", the center line distance between adjacent avenues on the MLS.

Thus, on any grid plan, where the center line distance between streets and avenues is assumed to be "a" and "b" expressed in feet, respectively, and where the travel speeds of vehicles in feet per second along the avenues and streets are assumed to be "Va" and "Vb", respectively, then the relative travel times between adjacent streets, from one street intersection to an adjacent street intersection, along the same avenue, and between avenues by travelling on a crossing street, "ta" and "tb" respectively, will be equal to "a" divided by "Va" and "b" divided by "Vb" expressed in seconds. The duration of both red and green phases, therefore, P, of the two phase signal cycle, expressed in seconds is, according to the present invention, equal to the sum of 2 times Ta plus Tb. From the calculation of P, the band width can then be determined.

If the duration of each signal cycle, P, is divided by Ta, then, "n", the number of traffic signals rounded off to whole numbers to be passed during a phase interval P, is derived. Thus, once it is determined what the average traffic speeds are for streets and avenues Vb and Va, respectively and the distances between adjacent streets and avenues, "a" and "b", the phase duration, P, and the band width n can be calculated. As mentioned, the present invention contemplates that parallel band widths on adjacent avenues be in reciprocal phases of the traffic signal on a first avenue and, in addition, that adjacent band widths on the same avenue also be reciprocal. The duration P, of the red and green signals for the avenues are substantially equal to one another as is the duration of the traffic signals for the phases on the crossing streets.

In simple mathematical terms:

$$P = 2\frac{(a)}{Va} + \frac{b}{Vb} + C$$

and $$N = \frac{2\frac{(a)}{Va} + \frac{b}{Vb} + C}{a/Va}$$

Where

P=phase duration in seconds.

b=distance between adjacent streets in ft.
b=distance between adjacent avenues in ft.
Va=travel speed on an avenue in ft./sec.
Vb=travel speed on a street in ft./sec.
C=Constant for Specific Road/Traffic Conditions.
N=bandwidth.

The foregoing formula may be modified to accommodate an upward revision of "P" during periods of extreme traffic congestion by a constant "C" based on platoon length if such length is greater than "a".

Of course, P, the phase duration, must be at least that amount of time so as to allow for pedestrians to safely move across crosswalks so that they can transfer from one corner to another corner without getting hit by a car. It is, of course, intended that pedestrian flow be controlled and coordinated with the vehicle traffic flow, preferably consistent with my invention as expressed in U.S. Pat. No. 5,092,705.

Figure 5:
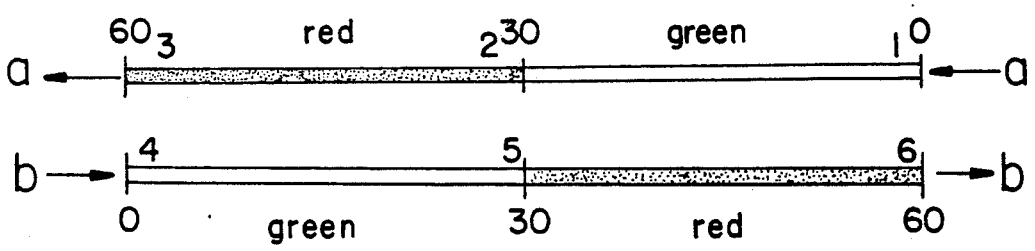
FIG. 5 is a schematic time and phase of traffic signal chart showing traffic signalization on two adjacent avenues. When one bad width is green, adjacent band widths on the same avenue are red. When one band width is green, parallel band widths on adjacent avenues d.

FIG. 5 demonstrates that the signalization concept results in a condition of reciprocal progression between adjacent avenues and streets carrying streams of traffic in opposite directions. Thus, when a lead platoon passes on an avenue through an intersection during a single phase interval, a reciprocal platoon is able to move in the opposite direction along an adjacent avenue past the same but parallel intersections during the same phase interval.

The Present Invention Superimposed on Manhattan, for Representative Illustration Purposes Currently, in Manhattan, the green light phase of a two phase traffic signal cycle, for avenue traffic, is about sixty seconds with the red phase being only about thirty seconds. Cross streets, therefore, on average, have the green phase at about thirty seconds with the red phase about sixty seconds. There are, of course, many cross streets where the green phase of the two phase traffic signal cycle is more than 30 seconds and, indeed, some major cross streets, 34th, 42nd, 86th, etc. seem to have the green phase substantially equal to the red phase. Traffic planners have tried to implement some progression of phase changes so that, in theory, a vehicle can travel up or down a one-way avenue with the lights turning from red to green in a staggered fashion as the vehicle approaches intersections. Thus, the vehicle progresses and is stopped less frequently then would be the case where no such signal progression exists. Even with the progression, however, for trips along the north-south avenues in Manhattan, on average, a vehicle will be stopped about twice per unit mile. Traffic flow along cross streets seem to come to a halt about five stops per unit mile as no progression is provided on the cross streets in the present system.

Basically, traffic flow in Manhattan is based on an imperfect model of the one-way traffic roadway system. There are, many major streets and avenues on the grid plan of Manhattan which are configured to accommodate two way traffic. They are the exception, not the rule. On average, for the purpose of illustration of the efficiency obtained by the present invention, centerline distances between adjacent cross streets, a, is more or less about 260 feet while centerline distances between adjacent north and south running avenues, b, being less uniform, is on the order of about 720 feet apart.

The inventor has conducted field investigations, along with a review of available traffic planning reports so as to provide some basis for comparing currently existing and actual traffic conditions and travel times on the Manhattan street system with the anticipated benefits to traffic conditions and travel times on the Manhattan street system if the MLS system is adopted along with the present invention for signalization coordination.

Basically, as previously discussed, traffic in Manhattan is aligned along alternating north-south major avenues (1st, 2nd, Third, Lexington, Park (Northerly and Southerly) Madison, Fifth, etc.) and, accordingly, traffic signalization on those avenues, carrying the bulk of traffic, are given priority with respect to traffic signals on the less wide crossing streets. This facilitates and promotes maximum traffic flow. Currently, traffic lights are desirably "progressive" along the north-south avenues, i.e., as previously discussed the lights at the street intersections progressively change as a vehicle travels along the desired direction of travel on an avenue. This is an attempt at minimizing the number of stops for that particular vehicle travelling along an avenue. As previously mentioned, however, even with the built-in progression, experience shows that typical trips along the north-south avenues have been determined to require about two stops per unit mile while, on average, about five stops per unit mile for trips along the major cross streets (east to west and vice-versa) have been found.

In Manhattan, currently, a ninety second total traffic signal cycle is split into a number of phases. The travel time efficiencies, resulting from a combination of wide avenues and signal progression, built into the north and south segments of most average trips (which include components of travel along both north or south, as well as east or west) are largely offset by the inefficiencies along the east to west legs of any such two directional trip. There is currently no "progression" built into the phase changes of traffic signals for a vehicle travelling on cross streets and, indeed, such a condition of biaxial progression is considered very difficult to achieve in the current state of technology.

The inventor has, by personal analysis and studies, determined that idling time ratios on the Manhattan street system are in the range of about 26 to 46% of total trip times. A 40% idling time ratio is considered as normal for Manhattan by the traffic planning community. Idling time delays and thus idling ratios are highest for simple, around-the-block type trips which, unfortunately, are one of the most frequent trip components conducted by a vehicle in Manhattan since an operator is often, at the end of a trip, looking for an available public parking space (at a premium) about a particular city block. These around-the-block type trip components currently require an average travel time of about three minutes, with about three idling stops per trip, even during off-peak traffic periods.

The inventor has recorded average vehicle travel speeds in Manhattan (without consideration of the idling time component). They ranged from about 17.5 miles per hour (Vb) in the east and west directions, (i.e., on cross streets) to about 19.5 miles per hour (Va) for north and south trips (along the avenues). Pedestrian street crossing times for various crosswalks at intersections of 34th street with various avenues ranged from about 11 seconds to about 22 seconds. Thus, any determination of the duration of the phase P must be greater than 22 seconds.

Figure 6A:
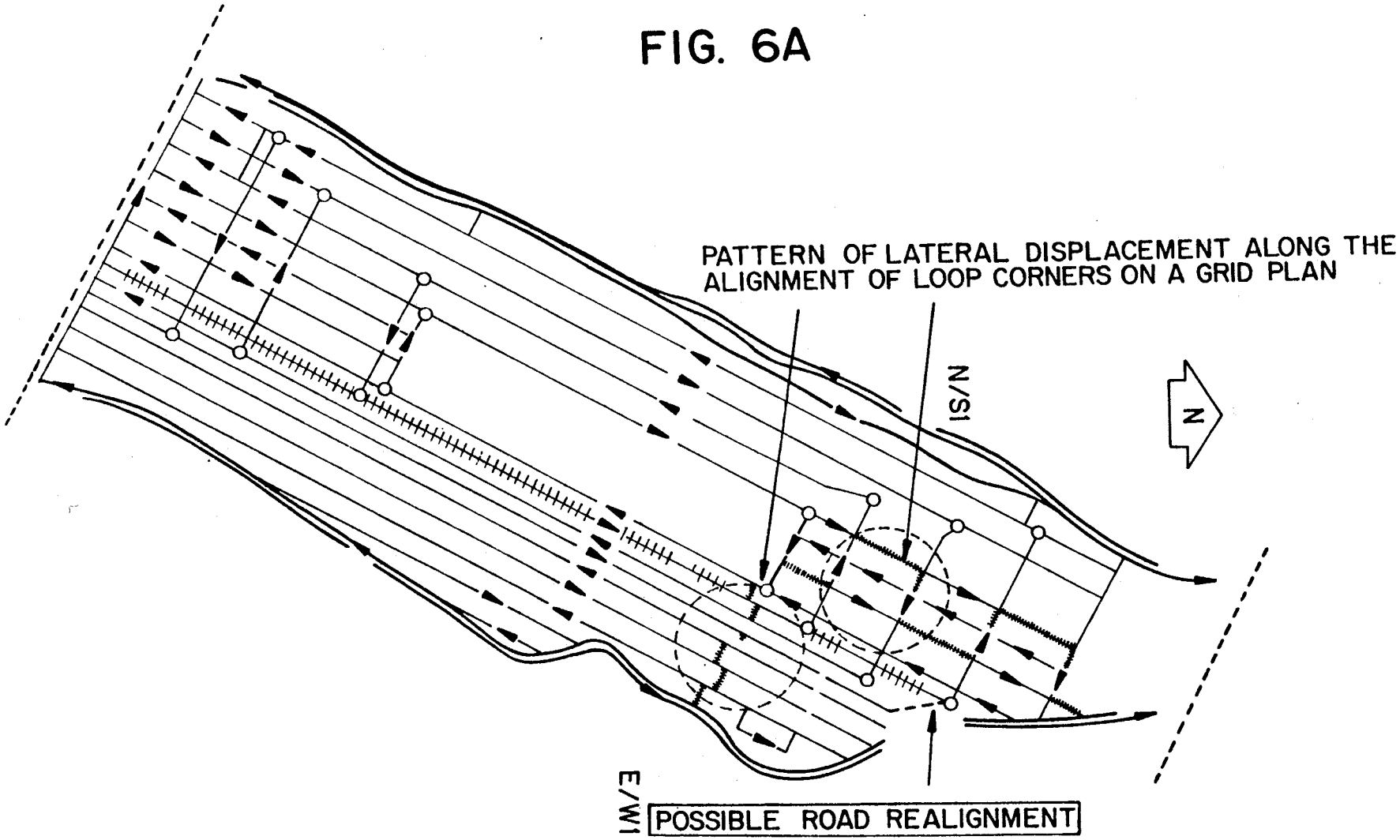
FIG. 6A shows implementation of the MLS onto the grid-plan street system of Manhattan.
Figure 6B:
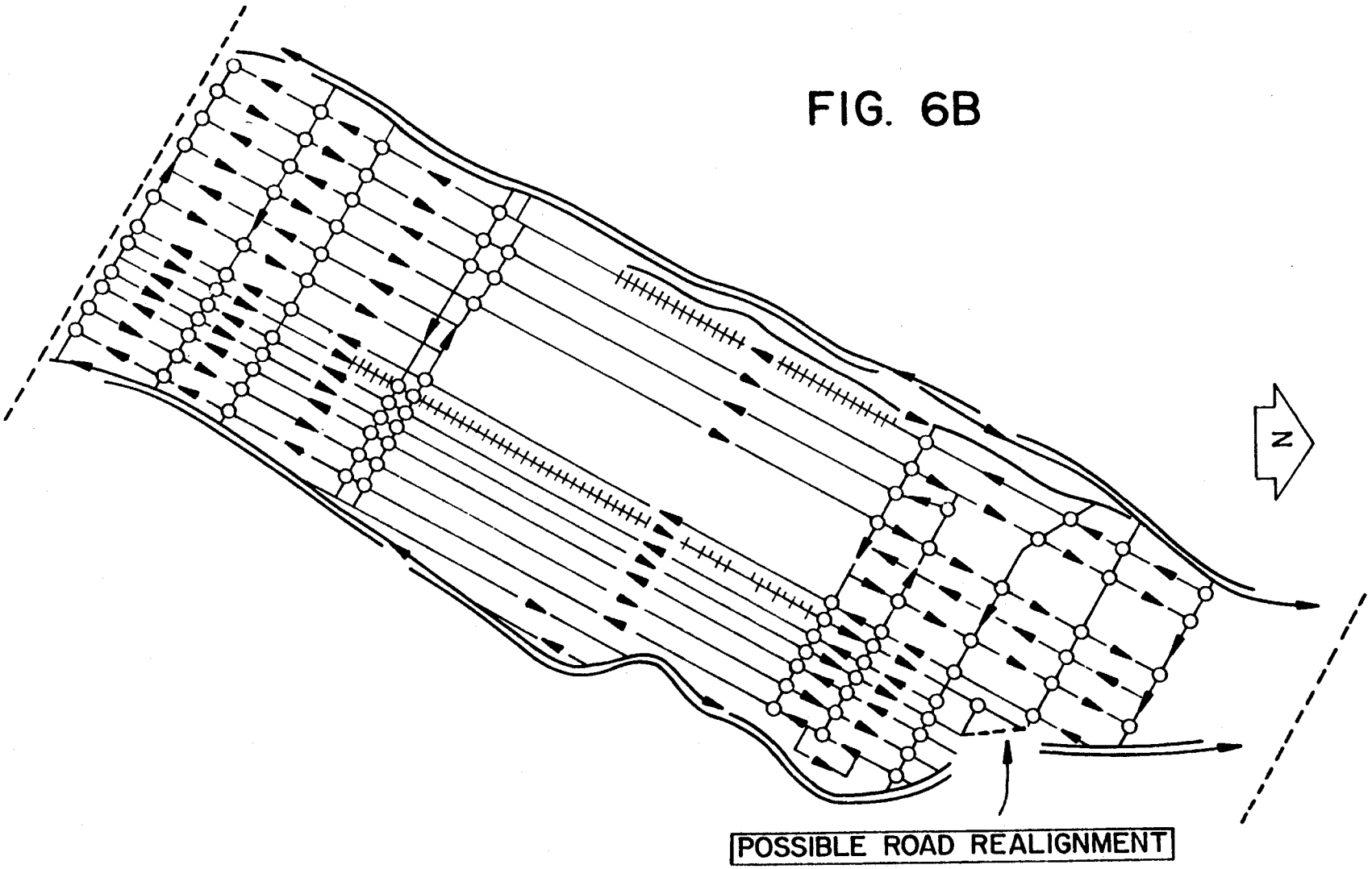
FIG. 6B shows implementation of the MLS onto the grid-plan street system of Manhattan, slightly modified to allow for vehicle cross-over at major crossing streets.

For purposes of illustration of a comparison between present travel times in Manhattan with those anticipated by implementation of the present invention, a strictly generic version of the MLS plan was superimposed on the existing Manhattan streets. The contemplated plan defines a series of endless loop roads, comprised of avenue segments and street segments, that are configured outwardly around Central Park, as shown in FIG. 6. The major sections of the endless loop roadways alternate fairly evenly along the currently existing avenues in the north to south direction. East and west cross streets are used to complete the endless loops. Interconnecting roads or loop to loop connecting cross streets are provided consistent with the MLS. Reference to my '288 patent is once again made. For present comparison purposes, it is contemplated that interconnecting roadways will exist along those east and west cross streets having the maximum available pavement width. Preferably, the east and west loop to loop cross streets will be located at, for example, 14th Street, 34th Street, 42nd Street, 57th Street and 86th Street. A review of FIG. 6A, therefore, makes it readily apparent that the generic, strict MLS plan would suffer some inefficiencies at the corners of the more inner located loop roads, when the traffic is forced from a "major" east and/or west corridor, e.g., 34th Street onto an adjacent east to west cross street since the other cross streets necessarily have less volume capacity in that they are not as wide as the major cross streets. Therefore, as an alternative or modification to the strict MLS system, the inventor contemplates that certain major, i.e. preferably wider east and west cross streets, actually depart slightly from the MLS concept and allow for traffic crossing over oncoming traffic. This allows a vehicle to travel directly across town without weaving. Unfortunately, that is contrary to the strict requirements of the basic MLS system as contemplated by U.S. Pat. No. 4,927,288. Nevertheless, for purposes of superimposing the MLS system on the existing streets of the Manhattan grid-like system, certain modifications to the ideal of the MLS system may be necessary. This is shown in FIG. 6B. Most, however, east and west cross streets are still required to conform to the basic MLS concept, i.e., they will not allow any traffic to cross over oncoming traffic. For comparison purposes, therefore, the second alternative, FIG. 6B, allowing selected major cross streets to direct traffic to cross over traffic, was examined.

Projected efficiencies in travel distances and travel times, based upon the modified MLS system, as signalized with the teachings of the present invention, compared to the current system of traffic signalization were determined.

Based upon the 17.5 and 19.5 mile per hour average traffic speeds along east and west cross streets Vb and north and south avenues, Va, respectively, and the distances between adjacent avenues "b", being about 720 feet, while the distance between adjacent cross streets, "a", being about 260 feet, one can derive the desired P and n for Manhattan. The phase duration, P, equals the time it takes a vehicle travelling at 17.5 and 19.5 mph, along the streets and avenues, respectively, to go a total distance 2a+b. Dividing the distances to be travelled by the average speed for each segment expressed in feet per second results in the phase duration, P. The phases are thus calculated. A determination was made that a suitable phase duration for the two phase signal cycle in Manhattan will be about 46 seconds. Since this is greater than the pedestrian cross walk time (22 seconds) it allows for pedestrians to safely utilize the crosswalks, too. Once it is determined that the phase duration should be about 46 seconds, then, n, the bandwidth, i.e., the number of street signals to be passed by a vehicle traveling along an avenue, can also be determined. In this example, therefore, when the phase duration is about 46 seconds, a vehicle traveling at about 19.5 miles per hour, Va, along an avenue, (with cross streets separated by about 260 feet) will pass about five such streets during the green or "go" phase. Thus, for purposes of illustration, in Manhattan, the phase duration of both the green and the red traffic signal of a two phase signal cycle should be about 46 seconds and the bandwidth, n, should be about five intersections.

Consistent with the present invention, therefore, substantially simultaneously, bands of five traffic signals along an avenue will simultaneously turn green (a complete band width) while the traffic signals on adjacent avenues, for the same band width, will simultaneously turn red. Adjacent band widths along the same avenue are also reciprocal to the phase of the first band width. Clearly, then, when a traffic signal is green for traffic on the avenue, the cross streets within the band width are red and while the traffic signal is red along the avenue the cross street traffic signal is green.

The 46-second phase interval, as has been just determined, allows for pedestrians to utilize the cross walks, even in the worst case situation on 34th Street and, in addition, allows for the intersection of a third phase of a signal cycle, i.e., a turning phase component, if desired. A third phase (a turning) can be added to the two phase signal cycle so that traffic turning off a major street can turn into the cross street without conflicting the pedestrian traffic on the crosswalk.

Six "time and motion" phase changes are illustrated and described in FIGS. 7A through 7F. The streets and avenues in FIGS. 7 are conformed substantially the same as previously, i.e., north and south travelling avenues carry+traffic in one-way directions along Avenues A1–AS, and east and west cross streets are designated S1–S4. Traffic flow is basically consistent with the MLS system and the present invention for signalization assumes pre-existing travel speeds, namely, 17.5 and 19.5 miles per hour, along the streets and avenues, respectively. For purposes of comparison, frequency of stops per unit mile, even with progression of traffic signals, of 2 and 5 times, along avenues and streets, respectively, have been assumed, too. They are believed to be functional constants common to the present grid system in Manhattan and the MLS system, as signalized pursuant to the present invention. Comparative travel time results between the present method and actually recorded trip times on Manhattan streets are shown in Table 1. Travel distances are compared in Table 2. Trip configurations used 2 mile trip lengths along North-/South corridor with 0.86 mile trip lengths along the E/W corridors with an assumed 60:40 N/S:E/W traffic distribution.

Figure 7A:
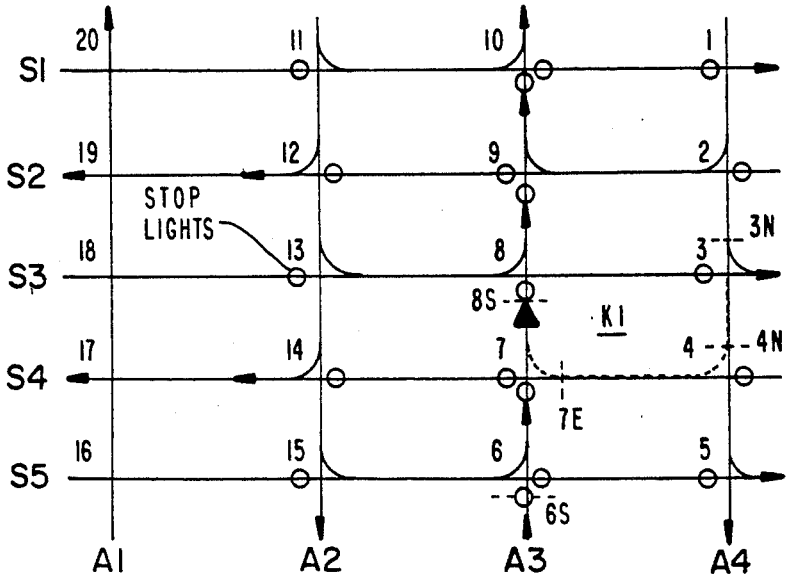
"FIG. 7A–7F illustrate time and motion phase changes on a road traffic network of the grid type comprised of parallel Avenues A1–A4 and crossing streets S1–S5, perpendicular to the avenues."

As shown in FIG. 7A: During Phase 1; (0 to 42 seconds after the start), when avenues"A2" and "A4" are in a green phase: a starting platoon "K1" is formed at crosswalk "8S" along avenue "A3" from fractional components of traffic stacked on crosswalks 3N, 4N and 7E at intersection "8".

Figure 7B:
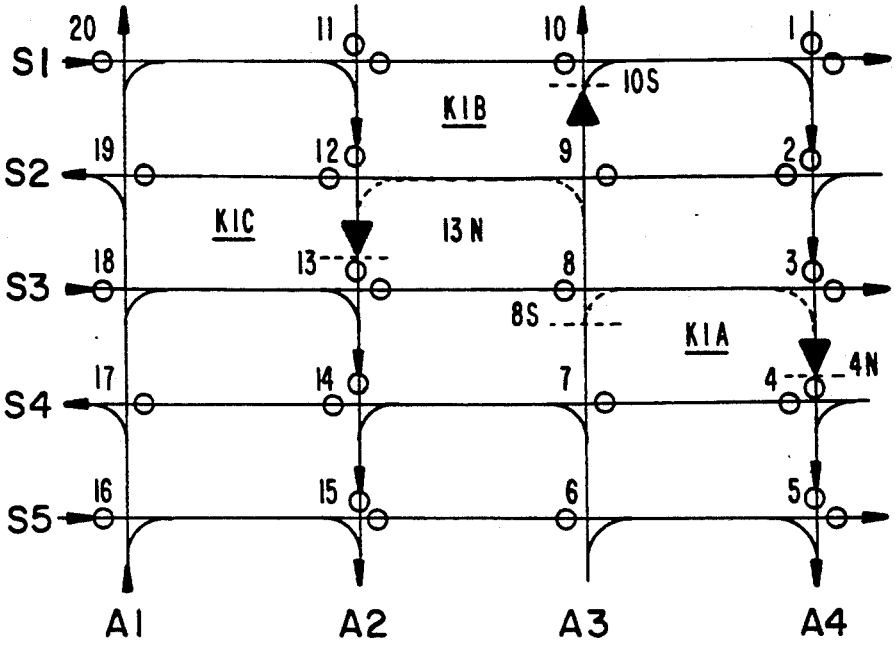

As seen in FIG. 7B: During Phase 2; (42 to 84 seconds after the start), when avenues "A2" turn red: a) One component "K1A" of the starting platoon "K1" turns east and moves to crosswalk "4N" on avenue "A4"; b) A second component "K1B" moves north on avenue "A3" and moves into reciprocating progressoin along said avenue; and c) a third component "K1C" moves west to crosswalk "13N" on avenue "A2".

Figure 7C:
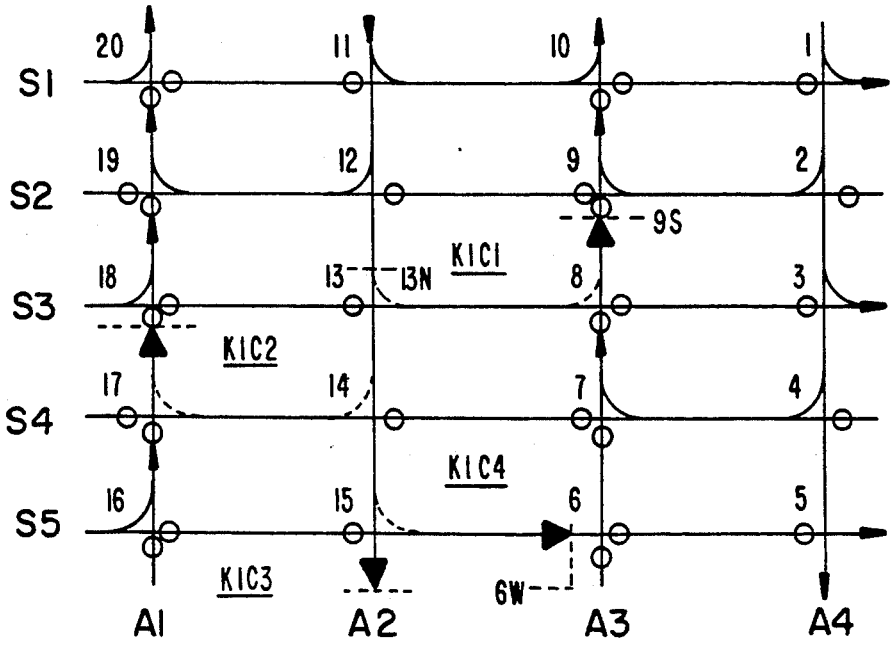

As shown in FIG. 7C: During Phase 3; (84 to 126 seconds after the start), when avenus "A2" and "A4" return to green: a) one component "K1C1" of "K1C" moves west to crosswalk "17S"; c) a third compeont "K1C3" of "K1C" moves south on avenue "A2" and moves into linear progression along said avenue; and d) a fourth component "K1C4" of "K1C" reaches crosswalk "6W".

Figure 7D:
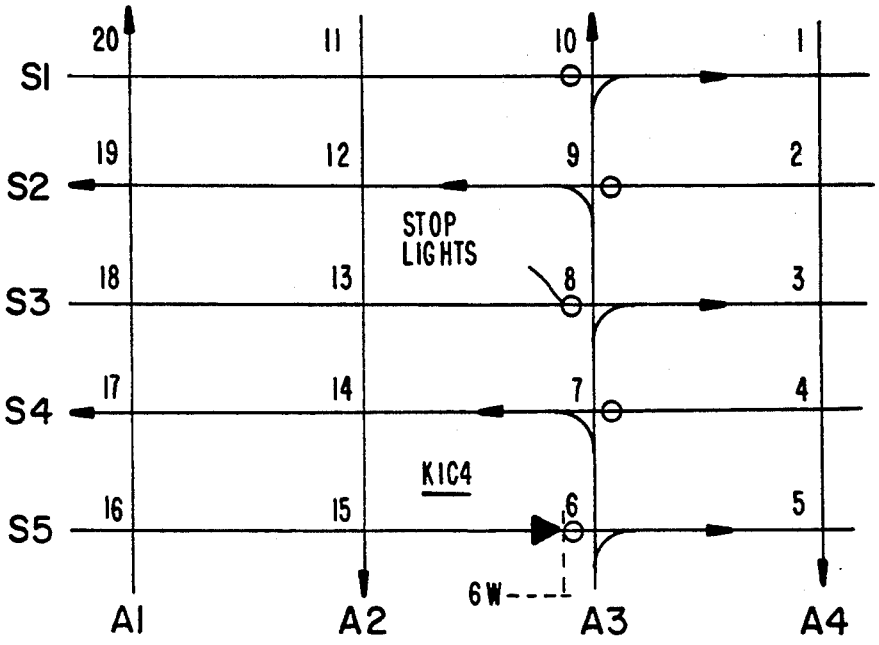

As seen in FIG. 7D: During Phase 4: (126 to 168 seconds after the start), when avenues "A2" and "A4" turn red again: a) Component "K1C2" moves into a sequence of reciprocating progression along the lateral axis, thereafter it takes 42 seconds for each loop crossing between adajcent avenues; and b) component "K1C4" waits out the fourth phase interval at crosswalk "6W", since avenue "A3" is red.

Figure 7E:
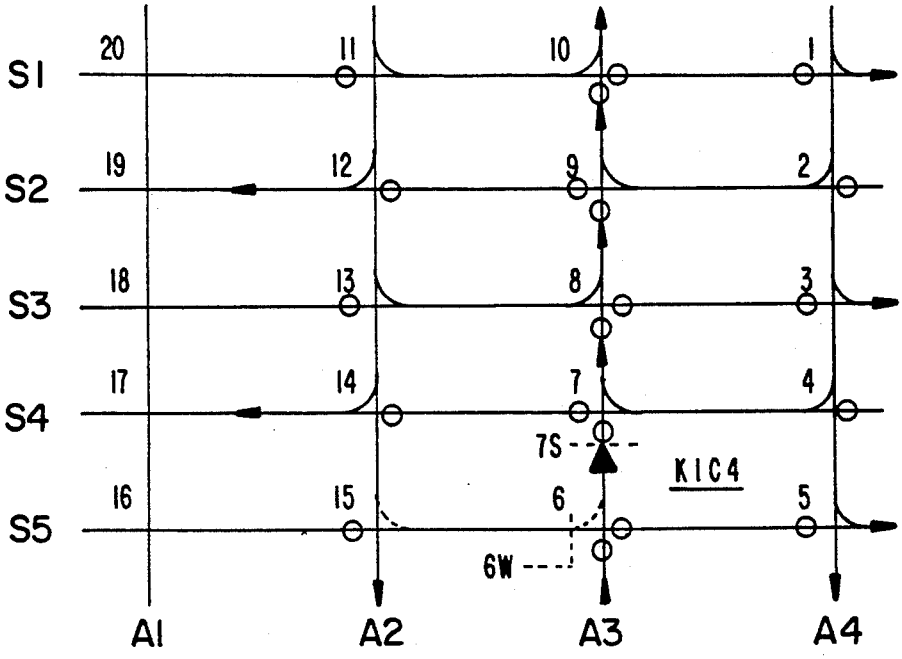

As seen in FIG. 7E: During Phase 5: (168 to 210 seconds after the start): when avenues "A2" and "A4" turn green for a third time: a) component "K1C4" moves to crosswalk "7S" on avenue "A3" and waits out the rest of the fifth phase interval.

Figure 7F:
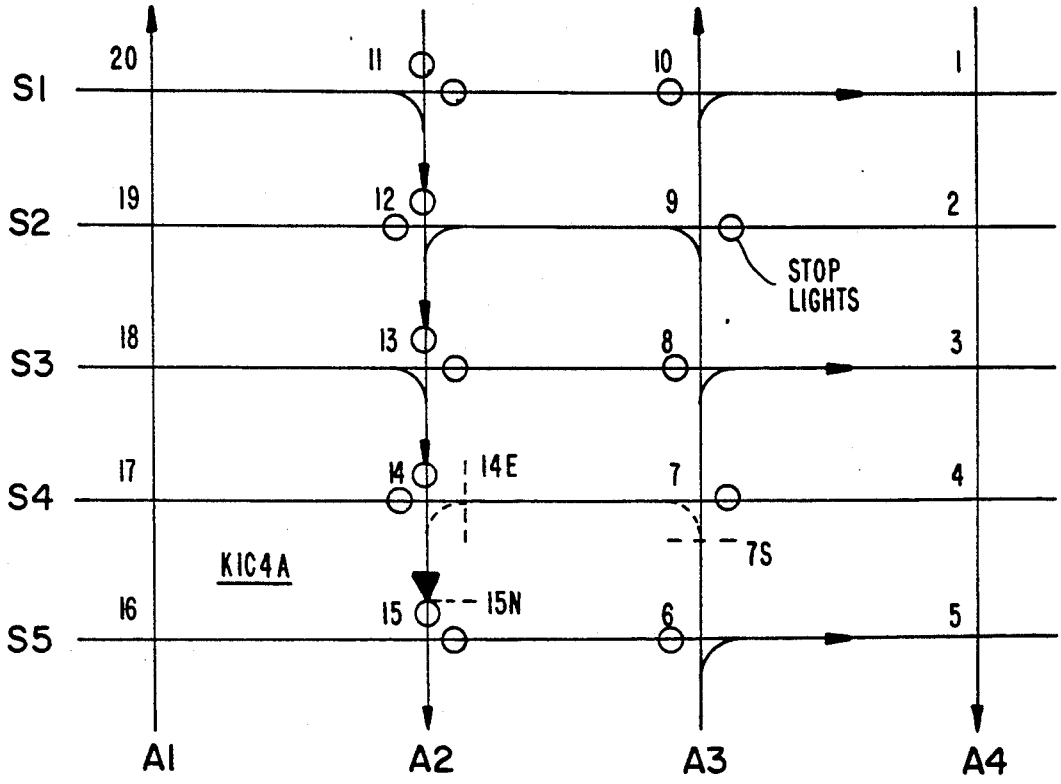

As seen in FIG. 7F: During Phase: (210 to 252 seconds after the start), when avenues "A2" and "A4" turn red for a third time; a sub component "K1C4A" of K1C4" turns west on street "S4" and reaches crosswalk "15N" on avenue "A2".

It can thus be determined that the present invention saves travel time on all trip configurations except that of a straight and direct crossing of an avenue which needs, for the MLS, weaving and the equivalent of six phase changes of a two-phase traffic signal cycle. Nevertheless, travel times are projected to improve overall by approximately 34% during peak rush hour and 7.5% during off peak hours. This assumes the trip distribution time indicated in the charts. A projected overall 15% increase in travel distances is expected. In addition, the present invention achieves major savings in travel times for all around-the-block type trips which by virtue of the fact that the same can now be accomplished without any stops (in 84 sec's), as mentioned, are a frequent component for many trips.

In partial conclusion, therefore, the MLS system can be applied to existing grid-like street and avenue systems. The implementation requires little new construction of bridges, tunnels or ramps. Costs include those for converting the signal control boxes, new road signage and user education. Whereas the pattern of movement along the endless loop roads is readily recognizable in terms of its similarity to existing patterns of traffic circulation, the weaving route for otherwise straight east/west cross trips can be confusing for some users and could meet with limited user resistance. In existing cities, the MLS system is most effective where high congestion and low levels of service now occur. The additional level of vehicular and pedestrian constraints, required by implementation of the MLS system, would be difficult to justify in suburban or residential communities in the interest of street safety and reduced traffic time alone.

According to the present invention, the MLS two phase basically equal traffic signal cycle is intended to operate such that a reciprocating or alternating sequence of red and green signal phases occur, for the same band widths, between immediately adjacent avenues. Thus, when avenues A-1, A-3 and A-5 are, for a given band width, B2,in the green phase, for example, allowing for vehicular traffic to flow northerly, the immediately adjacent avenues, A-2 and A-4, otherwise providing for southerly traffic flow, for B2, are in their red phase. Adjacent band widths B1 and B3 are opposite in phase to B2 for all avenues. The pattern of vehicular movement, evident in FIGS. 1, 2 and 3 is that of a series of interlocking streams wherein all segments of those avenues simultaneously in the green phase, initially, avenues A-1, A-3, and A-5 are either moving traffic forwardly or "off-loading" traffic onto lateral adjacent streets S-1 through S-4. Adjacent avenues, initially, avenues A-2 and A-4, for the same band width are then in the reciprocal "red" phase and are mostly, therefore, "on loading" traffic from the side streets S1-S4 onto the avenues. See FIG. 1. Thus, formation of "platoons" on the streets and avenues, i.e., stacked sets of vehicles occur when those streets and avenues are presented with red signal lights. After the initial phase of the signal cycle, for avenues A-1, A-3 and A-5, when the green lights of B2 turns to red, the avenues A-2 and A-4, for B2, initially red, change to green and avenues A-1, A-3 and A-5, for B2 presents red signals. B1 and B3 are always opposite in phase, for all avenues A1-A5 to B2 for the particular avenue. Then, vehicle traffic moves along avenues A-2 and A-4, southerly, either forwardly or by off-loading onto the side streets S1-S4, while the traffic from the side streets S1-S4 is allowed to on-load onto avenues A-1, A-3 and A-5 (FIG. 2).

A single traffic signal facing oncoming traffic at the intersection of each avenue and cross street either allows traffic to flow along the avenue and from the avenue onto a side street (when the signal is green for the avenue), or, alternatively, allows for traffic on the intersecting side street to on-load onto the avenue. When the signal is green for traffic on the side streets, the avenue traffic signal phase at that same intersection is, of course, "red. The MLS requires that all adjacent bandwidths on the same avenue also reciprocate in the two phase signal cycle relative to one another. Thus, when B2 on avenue A3 is green, band widths B1 and B3, also on A3 are red.

FIGS. 1 and 2 show the desired signalization of an MLS system and, yet, do not show a plurality of band widths. According to the more simple version of the signalization of the MLS, as depicted in FIGS. 1 and 2, the entire avenues A-i, A-3 and A-5 simultaneously turn green while the adjacent oppositely directed avenues A-2 and A-4 simultaneously turn red, along their entire lengths. However, according to the preferred embodiment of the present invention, as depicted in FIG. 3, the bandwidth is determined as that length of Avenue, assuming the vehicle travels straight there along, through which the vehicle can reasonably be expected to pass during an appropriate single phase of a two phase signal. This bandwidth, then, determines the length of the adjacent avenues having opposite or reciprocal traffic signals to a first band width.

FIG. 3 also illustrates the reciprocating sequence of phase changes in the traffic signals on a single avenue, i.e., adjacent band widths being opposite in phase. FIG. 3 shows traffic phases along the length of the bandwidth interfaces, too. These run across the major avenues. In FIG. 3, two bandwidth interfaces aa and bb are illustrated in reciprocal or opposite phases to one another. When interface "aa" is in a green phase (that is, traffic is stopped on the avenues and the major cross street has a "go" signal), interface bb is in its red phase, i.e., traffic is moving on the avenues but stopped on the cross streets.

Obviously, numerous variations of the above described structure can occur to those of skill in the art. The invention is not to be limited to that described. The claims which follow, as the same are interpreted by the Courts, is the true scope of this invention.

TABLE 1

COMPARISON OF TRAVEL TIMES FOR MANHATTAN "AS EXISTING" VERSUS THOSE EXTRAPOLATED FOR "MLS" (FIG. 6)

| | TRIP CONFIGURATION | TRAVEL TIMES (IN SECONDS) EXISTING STREET SYSTEM PEAK HOUR TRIP TIME | OFF PEAK HOUR TRIP TIME | MLS TRIP TIME | ASSUMED FREQUENCY DISTRIBUTION | WEIGHTED TRAVEL TIMES EXISTING STREET SYSTEM PEAK HOUR | OFF PEAK HOUR | MLS |
|---|---|---|---|---|---|---|---|---|
| 1 | 4N TO 4N VIA 7, 8, 3 +2 MILES N/S | 956 | 744 | 542 | 0.1 | 95.6 | 74.4 | 54.2 |
| 2 | 4N TO 9S VIA 7, 8, 9, 12, 13, 8 +2 MILES N/S | 965 | 760 | 551 | 0.1 | 95.6 | 76 | 55.1 |
| 3 | 6S +2 MILES NORTH ALONG AVE A3 | 892 | 560 | 506 | 0.4 | 356.8 | 224 | 202.4 |
| 4 | 4N LATERAL WEST FOR +0.95 MILES | 532 | 415 | 391 | 0.2 | 106.4 | 83 | 78.2 |
| 5 | 4N TO 14E VIA 7, 8, 9, 12 13, 14, 15, 6, 7 +.82 MILE | 456 | 356 | 510 | 0.2 | 91.2 | 71.2 | 100.2 |
| | | | | | TOTALS: | 746.5 | 528.6 | 490.1 |

TABLE 2

COMPARISON OF TRAVEL DISTANCES FOR MANHATTAN "AS EXISTING" VERSUS THOSE EXTRAPOLATED FOR "MLS"

| | TRIP CONFIGURATION | TRAVEL DISTANCES (IN FEET) EXISTING | MLS | ASSUMED FREQUENCY DISTRIBUTION | WEIGHTED TRAVEL DISTANCES EXISTING | MLS |
|---|---|---|---|---|---|---|
| 1 | 4N to 4N VIA 7, 8, 3 +2 MILES N/S | 12250 | 12250 | 0.1 | 1225 | 1225 |
| 2 | 4N TO 9S VIA 7, 8, 9, 12, 13, 8 +2 MILES N/S | 12500 | 12500 | 0.1 | 1250 | 1250 |
| 3 | 6S +2 MILES NORTH ALONG AVE A3 | 10560 | 10560 | 0.4 | 4224 | 4224 |
| 4 | 4N LATERAL WEST FOR +0.95 MILES | 5040 | 8160 | 0.2 | 1008 | 1632 |
| 5 | 4N TO 14E VIA 7, 8, 9, 12 13, 14, 15, 6, 7 +.82 MILE | 4320 | 7480 | 0.2 | 864 | 1496 |

NOTES:

1. USER DISTRIBUTION RATIOS ARE BASED ON A 60:40 N/S:E/W TRAFFIC LOAD WHERE IN TRIPS 1, 2, & 3 ARE ESSENTIALLY N/S TRIPS AND 4 & 5 ARE ESSENTIALLY E/W TRIPS.
2. ASSUMED TRIP DISTANCES AND TRAVEL TIME EXTRAPOLATIONS ARE DERIVED OUT OF FIG. 6 BY ADDING 2.00 MILES TO N/S TRIP CONFIGURATIONS, AND +/−7 CITY BLOCKS TO E/W TRIP CONFIGURATIONS.
3. TRAVEL TIMES ON THE EXISTING STREET PLAN ARE BASED ON FIELD MEASUREMENTS BY AUTHOR.
4. MLS TRIP TIMES ARE ADJUSTED UPWARD BY 69 SEC.'S/MILE TO ALLOW FOR A RANDOM TRAFFIC CONGESTION CONDITION NOT EVIDENT IN THE PURE MODEL FIG. 6.

I claim as follows:

1. A method of controlling traffic signals, on a road traffic network of a type having a plurality of grid-like intersections between a first set of road portions running substantially parallel to one another and a second set of road portions also running substantially parallel to one another, yet at about right angles to said first set of road portions, comprising the steps of:

(1) providing at each of said intersections, a vehicle traffic signal having two major phases, "go" and "stop" of substantially equal time duration; and (2) determining said time duration, designated P, according to the equation $P=2Ta+tb$ of each major phase of said vehicle traffic signal by calculating the expected time, ta, for a vehicle to travel a distance designated "a", starting, on a first road of said first set of road portion, from a first intersection with a first road portion of said second set of road portions to an adjacent intersection with a second road portion of said second set of road portions, and wherein the time, designated tb is the expected time of travel a distance designated "b", the distance between a road portion of said second set of road portions, from a first intersections with a road portion of a first set of road portions to an adjacent intersection.

2. A method of controlling traffic signals as claimed in claim 1, wherein said time duration, P, is about 46 seconds.

3. A method of controlling traffic signals as claimed in claim 1 wherein:

(1) the distance "a" is about 260 feet;

(2) the distance "b" is about 720 feet; and (3) the speed of said vehicles on said first and second sets of road portions is about 19.5 and 17.5 m.p.h., respectively.

4. A method of controlling traffic signals as claimed in claim 1 wherein said road traffic network is part of a Multiple Loop System.

5. A method as claimed in claim 4 further comprising a modification to the Multiple Loop System such that selected of said road portions interconnecting one way endless loops of said Multiple Loop System allow vehicles to cross over vehicles travelling on said endless loops.

6. A method of controlling traffic signals as claimed in claim 1 wherein ta=o (zero).

7. A method of controlling traffic as claimed in claim 1 such that a band width is defined as the whole number of intersections expected to be passed by a vehicle travelling on a road portion of said first set of road portions during the "go" phase of said traffic signal and adjacent band widths on a first road portion of said first set of road portions are opposite in phase to one another.

8. A method of controlling traffic as claimed in claim 7 wherein, for one of said majors phase of said traffic signal on a first band width on a road portion of said first set of road portions, the major phase of said signal cycle on parallel band widths of other, yet parallel road portions of said first set of road portions is opposite.

9. A method of controlling traffic as claimed in claim 6 wherein said band width is 6.

10. A method of controlling traffic as claimed in claim 1 wherein the phase of a traffic signal facing a first of said road portions is opposite in phase to the phase of the same traffic signal facing a road portion of said second set of road portions, at an intersection between said first and second road portions.

11. A method of controlling traffic as claimed in claim 1 wherein said first set of road portions are wider than said second set of road portions.

12. A method as claimed in claim 1, wherein said first set of road portions are avenues and said second set of road portions are cross streets.

13. A method as claimed in claim 1 wherein said road traffic network is constrained to provide traffic flow substantially consistent with a MLS and said first and second road portions are avenues and crossing streets, respectively.

14. A method as claimed in claim 13 wherein said road traffic network is superimposed on the road system of Manhattan, N.Y.

15. A method as claimed in claim 1 wherein:

$$P=2\,(a/va)+(b/va)+c$$

where: a =distance in ft. between adjacent intersections of said first set of road positions;

va=travel speed in ft./sec. or said first set of road portions;

b=distance in ft. between adjacent intersections on said second set of road portions;

vb=travel speed in ft.sec, on said second set of road positions; and

C=Constant dependent upon road conditions and traffic flow.

16. A method as claimed in claim 15 wherein:

$$N=\frac{2(a/Va)+b/Vb+C}{a/Va}$$

where N=bandwidth.

17. A method as claimed in claim 15 wherein C is determined in relation to traffic flow anticipated for the time of day.

18. A method of controlling vehicle traffic on a grid like system of avenues and crossing streets comprising the steps of:

(1) providing a two-phase traffic signal at each intersection for directing oncoming vehicle traffic to "go" or "stop";

(2) fixing a time for the duration of the phases of said traffic signal so that the "go" signal on an avenue is about equal to the "go" signal on the crossing streets and the phase displayed to oncoming traffic on the avenue at an intersection is opposite in phase to that displayed to oncoming traffic on the crossing street, at the same intersection;

(3) defining "a" as the center-line distance between adjacent crossing streets, along an avenue;

(4) defining "b" as the center-line distance between adjacent avenues, along a crossing street;

(5) defining an average vehicle traffic speed along the avenues and crossing streets as Va and Vb, respectively; and (6) setting the time duration, P, of each phase of said traffic signal by calculating the time that a vehicle, travelling at speeds Va and Vb, will take to travel a distance 2a +b.

19. A method as claimed in claim 18 wherein "a" is about 260 feet; "b" is about 720 feet; Va is about 19.5 m.p.h. and Vb is about 17.5 m.p.h.

20. A method as claimed in claim 18 wherein P is about 46 seconds.

21. A method as claimed in claim 18 wherein said calculation of P is equal to b/Vb when "a"=o (zero).

22. A method as claimed in claim 15 wherein said avenues and crossing streets are operated substantially consistently with the principles of a MLS.

23. A method as claimed in claim 22, wherein, on selected crossing streets of relative wider pavement, during a "go" phase of traffic signal cycle, traffic is allowed to cross over traffic travelling on said avenues intersecting said selected crossing streets.

24. A method as claimed in claim 18 wherein:

(a) a band width "n" is defined as the whole number of intersections passed by a vehicle travelling at a speed Va on an avenue for time duration P, and (b) adjacent bandwidths on the same avenue are opposite in phase to one another.

25. A method as claimed in claim 24 wherein parallel band widths on adjacent avenues are opposite in phase to one another.

26. A method as claimed in claim 24 wherein n is about equal to 5.

27. A method as claimed in claim 24 wherein adjacent band interfaces are opposite in phase.

* * * * *